US006432211B1

(12) United States Patent
Schmitt et al.

(10) Patent No.: US 6,432,211 B1
(45) Date of Patent: Aug. 13, 2002

(54) METHOD OF CLEANING A PRINTING FORM AND CLEANING FLUID THEREFOR

(75) Inventors: Dieter Schmitt, Sandhausen; Reiner Schmitt, Nussloch, both of (DE)

(73) Assignee: Heidelberger Druckmaschinen A.G., Heidelberg (DE)

( * ) Notice: Subject to any disclaimer, the term of this patent is extended or adjusted under 35 U.S.C. 154(b) by 0 days.

(21) Appl. No.: 09/104,306

(22) Filed: Jun. 24, 1998

(30) Foreign Application Priority Data

Jun. 24, 1997 (DE) ..... 197 26 700

(51) Int. Cl.[7] ..... B08B 7/04; B08B 3/04

(52) U.S. Cl. ..... 134/6; 134/26; 134/32; 134/33; 134/34; 15/256.51; 15/256.52; 101/423; 101/424; 101/425

(58) Field of Search ..... 134/1.3, 2, 3, 26, 134/27, 28, 6, 34, 32, 33; 510/170, 171, 174, 175; 15/256.1, 256.52, 23, 97; 101/423, 424, 425

(56) References Cited

U.S. PATENT DOCUMENTS

| | | | | |
|---|---|---|---|---|
| 4,504,406 A | * | 3/1985 | Dhillon | |
| 4,655,136 A | * | 4/1987 | Reiss et al. | |
| 4,716,098 A | * | 12/1987 | Mack et al. | |
| 4,880,555 A | * | 11/1989 | Walls et al. | 252/143 |
| 4,915,955 A | * | 4/1990 | Gomori | 424/616 |
| 4,983,317 A | * | 1/1991 | Requejo et al. | 252/174.24 |
| 5,217,848 A | * | 6/1993 | Uehara et al. | |
| 5,259,969 A | * | 11/1993 | Srivatsa et al. | 252/60 |
| 5,408,930 A | * | 4/1995 | Loos | |
| 5,424,001 A | * | 6/1995 | Bayless | 252/170 |
| 5,547,917 A | * | 8/1996 | Defieuw et al. | 503/227 |
| 5,578,134 A | * | 11/1996 | Lentsch et al. | 134/3 |
| 5,667,594 A | * | 9/1997 | Omure et al. | 134/26 |
| 5,691,288 A | | 11/1997 | Dhillon | |
| 5,691,289 A | * | 11/1997 | Purcell et al. | 510/174 |
| 5,863,710 A | * | 1/1999 | Wakiya et al. | 430/331 |

FOREIGN PATENT DOCUMENTS

| | | | |
|---|---|---|---|
| DE | 34 01 159 A1 | | 8/1984 |
| DE | 36 07 908 A1 | | 9/1986 |
| DE | 264 869 A1 | | 11/1987 |
| DE | 195 15 721 A1 | | 11/1996 |
| EP | 0 527 315 A2 | | 2/1993 |
| GB | 1 540 386 | | 2/1979 |
| GB | 2289438 A | * | 11/1995 |
| GB | 2 300 388 A | | 11/1996 |

OTHER PUBLICATIONS

Published International Application No. WO92/16607 (Hölle), dated Oct. 1, 1992.

* cited by examiner

*Primary Examiner*—Alexander Markoff
(74) *Attorney, Agent, or Firm*—Laurence A. Greenberg; Werner H. Stemer; Gregory L. Mayback

(57) ABSTRACT

A method of cleaning an imaged printing form having a silicone-based non-printing layer, which includes exerting a defined contact pressure by a cleaning arrangement on a printing-form surface to be cleaned, and moving at least one of the printing form and the cleaning arrangement relative to the other, further includes applying cleaning fluid to the printing-form surface to be cleaned, the cleaning fluid, besides water, containing a cleaning concentrate as a component, the cleaning concentrate having 1 to 30 percent by weight of an anionic surfactant and 1 to 30 percent by weight of a nonionic surfactant; and a cleaning fluid for cleaning a printing form.

42 Claims, 2 Drawing Sheets

METHOD OF CLEANING A PRINTING FORM AND CLEANING FLUID THEREFOR

BACKGROUND OF THE INVENTION

FIELD OF THE INVENTION

The invention relates to a method of cleaning a printing form to which an image has been applied, particularly for eliminating imaging residues from a printing form, the thus imaged printing form having a non-printing silicone-based layer, the cleaning method including exerting a defined contact pressure by a cleaning member on the surface of the printing form to be cleaned, moving at least one of the printing form and the cleaning member relative to the other, and applying cleaning fluid to the printing-form surface to be cleaned. The invention also relates to a cleaning fluid for cleaning a printing form.

The imaging of or application of an image to a printing form or printing plate is effected directly in the printing press by a computer without any conventional platemaking. The computer receives data from electronic publishing systems for bitmap data files to be produced in a Raster Image Processor and transmits a bitmap to the respective printing units for each color that is to be printed. Each printing unit includes a recording or scanning head which records or applies an image onto a respective, specially coated printing form mounted on the respective printing-form cylinder. The printing forms, respectively, may have a three-layer construction, e.g., a carrier layer having a polyester base, a printing layer with a titanium base which is applied onto the carrier layer and may have infrared-absorbing properties, and a non-printing layer having a silicone base, such as silicone rubber, for example, which is applied onto the printing layer. Such printing forms may be used in offset printing without any dampening liquid, thus, in so-called dry offset printing. The printing forms can be clamped onto the printing-form cylinder as printing plates or printing foils or can be applied to the printing-form cylinder in any other manner. It is also possible to apply a liquid layer onto the printing-form cylinder and to subject the liquid layer subsequently to curing. This ablative imaging can be performed with the aid of a recording or scanning head, in that, for example, through discharges or sparks produced by electrodes or through laser beams produced by laser diodes, the ink-conducting layer is exposed, the non-printing cover layer in the dot-printing locations being thermally decomposed or evaporated. Particles and converting components of the non-printing layer and possibly also of the slightly affected printing layer in the printing regions of the printing form remain as residues of this imaging process. These imaging residues must be removed, so that optimal ink acceptance in the printing regions is assured and no scumming occurs, and a printed image of high quality attained. The removal of the imaging residues can be performed manually and/or mechanically by cleaning equipment including a fixedly mounted cleaning member, such as a cleaning cloth, which, for example, by turning the plate cylinder, performs a movement relative to the printing-form surface to be cleaned, while exerting a suitably metered amount of pressure on the printing-form surface. In this regard, a printing-form cleaning fluid can be sprayed or otherwise applied, before or during the cleaning process, to the cleaning member and/or the printing-form surface to be cleaned.

German Patent 195 15 721 describes a device for cleaning cylinder surfaces in rotary printing presses by which a cleaning cloth, during the cleaning process, is pressed in an especially advantageous manner against the outer cylindrical surface of the cylinder to be cleaned, so that discrepancies in the shape or structure of the pressed-on material are equalized and the contact pressure becomes uniform over the format width. This permits a sufficiently high contact or press-on pressure to be generated, so that silicone residues and other residues on the printing-form surface resulting from direct imaging are entirely removed by the cleaning-cloth web, after the residues have been loosened or solvated. Furthermore, any possible chemical effect upon a press-on element for pressing down the cleaning cloth by an aggressive washing solution containing solvents for solvating the silicone is thereby avoided.

It has become known heretofore that alcohol-containing fluids, e. g. isopropanol-containing cleaning fluids, can be used for cleaning printing forms with a titanium-based printing layer and a silicone-based non-printing layer. Such cleaning fluids are also used for removing ink residues and other soil or contaminants from rollers and cylinders in printing presses. The low flash point of the isopropanol in the cleaning fluid has a disadvantageous effect, however. The evaporating isopropanol in the printing-form cleaning process, together with the atmospheric air, can become an inflammable gaseous mixture which can be ignited, due to the high temperatures caused by the further imaging process immediately following the cleaning of the print form. In order to counteract the danger of explosion, it is necessary to exhaust the gaseous mixture during the cleaning process, because, for economic reasons, there is not much time between the imaging processes of two printing forms for sufficient volatilization and distribution of the gaseous mixture to be expected. Also, isopropanol-containing cleaning fluids are more or less hazardous to health, depending upon the isopropanol concentration.

SUMMARY OF THE INVENTION

It is accordingly an object of the invention to provide a method of cleaning a printing form and a cleaning fluid therefor, by which a thorough removal of imaging residues from a printing form is achievable, and in which a cleaning fluid for cleaning the printing form is used which avoids the aforementioned disadvantages of the prior art.

With the foregoing and other objects in view, there is provided, in accordance with one aspect of the invention, a method of cleaning an imaged printing form having a silicone-based non-printing layer, which includes exerting a defined contact pressure by cleaning equipment on a printing-form surface to be cleaned, and moving at least one of the printing form and the cleaning equipment relative to the other, which comprises applying cleaning fluid to the printing-form surface to be cleaned, the cleaning fluid, besides water, containing a cleaning concentrate as a component, the cleaning concentrate having 1 to 30 percent by weight of an anionic surfactant and 1 to 30 percent by weight of a nonionic surfactant.

In accordance with another mode of the method of the invention, the cleaning concentrate contains alkyl-benzene sulfonate as an anionic surfactant.

In accordance with a further mode of the method of the invention, the cleaning concentrate contains alcoholic ethoxylate as a nonionic surfactant.

In accordance with an added mode of the method of the invention, the cleaning concentrate contains 0.1 to 5 percent by weight of a lubricant component.

In accordance with an additional mode of the method of the invention, the cleaning concentrate contains carbamide (urea) as the lubricant component.

In accordance with yet another mode of the method of the invention, the cleaning concentrate contains aliphatic acid diethanol amide as the lubricant component.

In accordance with yet a further mode of the method of the invention, the cleaning concentrate contains 1 to 25 percent by weight of a solubilizer.

In accordance with yet an added mode of the method of the invention, the cleaning concentrate contains preservatives.

In accordance with yet an additional mode of the method of the invention, the cleaning concentrate contains 0.05 to 3 percent by weight of the preservatives.

In accordance with still another mode of the method of the invention, the cleaning fluid contains a disinfectant having a sodium-silver chloride-complex base.

In accordance with still a further mode of the method of the invention, the cleaning concentrate contains complexing agents.

In accordance with still an added mode of the method of the invention, the cleaning concentrate contains 0.1 to 2 percent by weight of hardness stabilizers.

In accordance with still an additional mode of the method of the invention, the cleaning fluid contains 1 to 25 percent by volume of the cleaning concentrate.

In accordance with another mode of the method of the invention, the cleaning fluid contains 1 to 2.5 percent by volume of the cleaning concentrate.

In accordance with a further mode of the method of the invention, the cleaning fluid has a negative common logarithm of hydrogen-ion concentration with a value between 5 and 8.

In accordance with another aspect of the invention, there is provided a cleaning fluid for cleaning an imaged printing form having a silicone-based non-printing layer, comprising, besides water as a component, a cleaning concentrate containing 1 to 30 percent by weight of an anionic surfactant and 1 to 30 percent by weight of a nonionic surfactant.

In accordance with a further feature of the cleaning fluid of the invention, the cleaning concentrate contains alkylbenzene sulfonate.

In accordance with an added feature of the cleaning fluid of the invention, the cleaning concentrate contains alcoholic ethoxylate.

In accordance with an additional feature of the cleaning fluid of the invention, the cleaning concentrate contains 0.1 to 5 percent by weight of lubricant components.

In accordance with yet another feature of the cleaning fluid of the invention, the cleaning concentrate contains aliphatic acid diethanol amide as lubricant component.

In accordance with yet a further feature of the cleaning fluid of the invention, the cleaning concentrate contains carbamide (urea) as lubricant component.

In accordance with yet an added feature of the cleaning fluid of the invention, the cleaning concentrate contains 1 to 25 percent by weight of solubilizer.

In accordance with yet an additional feature of the cleaning fluid of the invention, the cleaning concentrate contains preservatives.

In accordance with still another feature of the cleaning fluid of the invention, the cleaning concentrate contains 0.05 to 3 percent by weight of the preservatives.

In accordance with still a further feature of the cleaning fluid of the invention, the cleaning concentrate contains a disinfectant having a sodium-silver-chloride-complex base.

In accordance with still an added feature of the cleaning fluid of the invention, the cleaning concentrate contains complexing agents.

In accordance with still an additional feature of the cleaning fluid of the invention, the cleaning concentrate contains 0.1 to 2 percent by weight of hardness stabilizers.

In accordance with another feature of the cleaning fluid of the invention, the cleaning fluid contains 1 to 25 percent by volume of cleaning concentrate.

In accordance with a further feature of the cleaning fluid of the invention, the cleaning fluid contains 1 to 2.5 percent by volume of cleaning concentrate.

In accordance with an added feature of the cleaning fluid of the invention, the cleaning fluid has a negative common logarithm of hydrogen-ion concentration with a value between 5 and 8.

In accordance with an additional feature of the cleaning fluid of the invention, the printing form has a non-printing layer formed of silicone rubber.

In accordance with a concomitant feature of the cleaning fluid of the invention, the printing form has a titanium-based printing layer.

It is furthermore noted that the cleaning concentrate may contain water.

Surprisingly, it has become apparent that good cleaning results can be achieved when, instead of an alcohol-containing cleaning fluid, a cleaning fluid is used which contains, besides water, a cleaning concentrate that can also be used for the household, e.g., for washing dishes. In this way, the danger of an explosion is eliminated and health and environmental requirements can best be complied with. Further tests have shown that the best cleaning effect is achieved with a cleaning fluid composed with the percentage proportions mentioned above. Cloths can be used as a suitable cleaning member, particularly, cloths which are advanced with a stepping motion, or bands, rollers, brushes brush rollers and press-on elements having a fabric, velour, non-woven fabric or other type of surface structure with a suction and/or cleaning effect.

The use of such a cleaning member, together with the cleaning fluid according to the invention, permits a thorough cleaning of the printing form and prevents damage to the printing form by scratching, and so forth, when cleaning is performed in an appropriate manner. Thus, scumming as a result of insufficient cleaning can be avoided in the subsequent imaging process as well. The relative movement between the printing form and a fixedly or stationarily mounted cleaning member should preferably occur at a considerably slower speed than the printing-press speed, i.e., at a so-called crawl speed. An additional traversing movement of the cleaning member in the direction of the axis of the plate cylinder is possible. Multiple cleaning operations may be provided, for example, a dry main-cleaning operation with removal of the imaging residues by suction and a subsequent fine-cleaning operation by using the cleaning fluid, a rinsing and dry-wiping operation while changing the rotary speed and the direction of rotation of the printing-form cylinder, a cleaning member-replacement operation and the use of multiple cleaning fluids with different percentage proportions of components and concentration of the cleaning concentrate during the process of cleaning a printing form.

The method according to the invention may be utilized for cleaning imaged offset printing forms for conventional offset printing using a dampening medium, for cleaning dry-offset printing forms in the case of waterless offset printing, for cleaning the imaged printing forms for direct flat-bed printing (dilitho), as well as for cleaning printing forms imaged directly by a computer-to-press or computer-to-plate system, when the aforementioned printing forms have a silicone-based non-printing layer.

Other features which are considered as characteristic for the invention are set forthe in the appended claims.

Although the invention is illustrated and described herein as a method of cleaning a printing form and cleaning fluid therefor, it is nevertheless not intended to be limited to the details shown, since various modifications and changes may be made therein without departing from the spirit of the invention and within the scope and range of equivalents of the claims.

The method of operation of the invention, however, together with additional objects and advantages thereof will be best understood from the following description of specific modes thereof when read in connection with the accompanying drawings, wherein:

DESCRIPTION OF THE PREFERRED EMBODIMENTS

Figure 1:
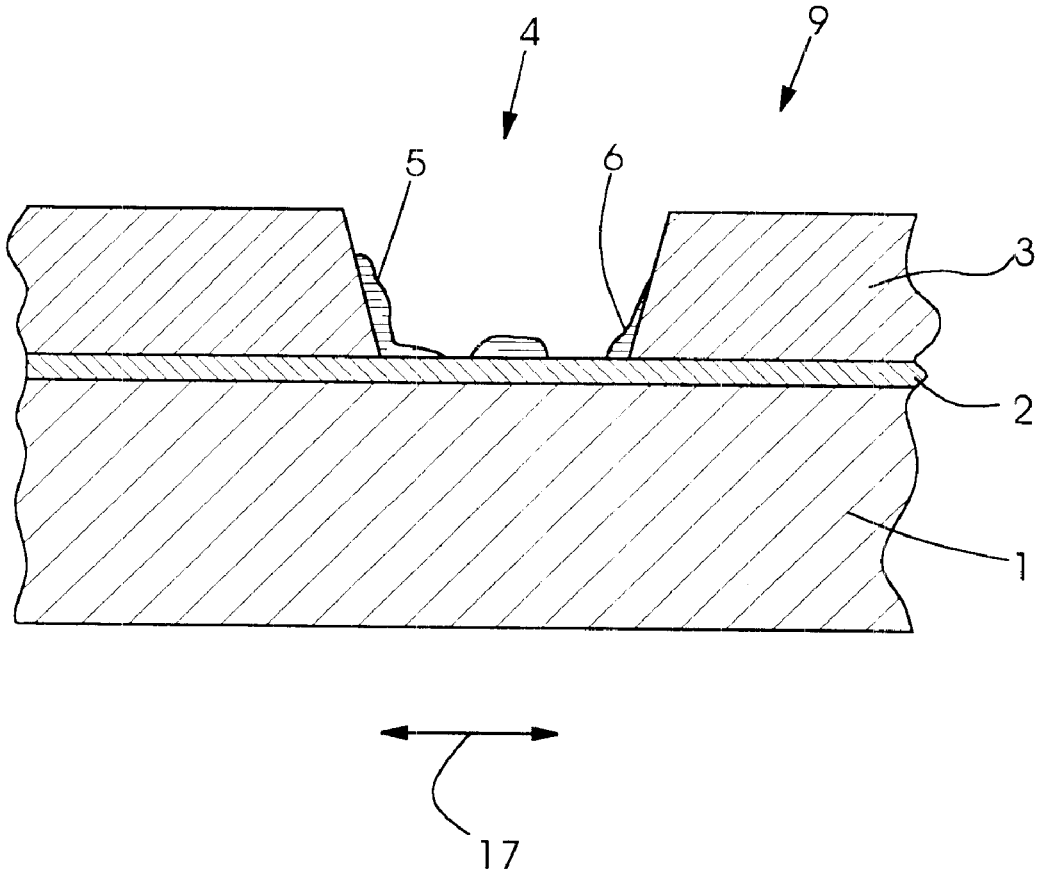
FIG. 1 is a fragmentary diagrammatic cross-sectional view of a printing form having an image of a halftone or screen dot applied thereto.

Referring now to the drawings and first, particularly, to FIG. 1 thereof, there is shown therein the structure of an imagable printing form, i.e., a printing form onto which an image may be applied, which includes a sturdy polyester-based carrier layer 1 having a thickness of 0.18 mm, for example, a titanium-based printing layer 2, and a silicone-based non-printing layer 3 having a thickness of 2 to 3 $\mu$, for example. The imagable printing form of FIG. 1 also exhibits an image of a halftone or screen dot having a diameter of 35 $\mu$, for example, with imaging residues 5 and 6 around the base thereof.

Figure 2:
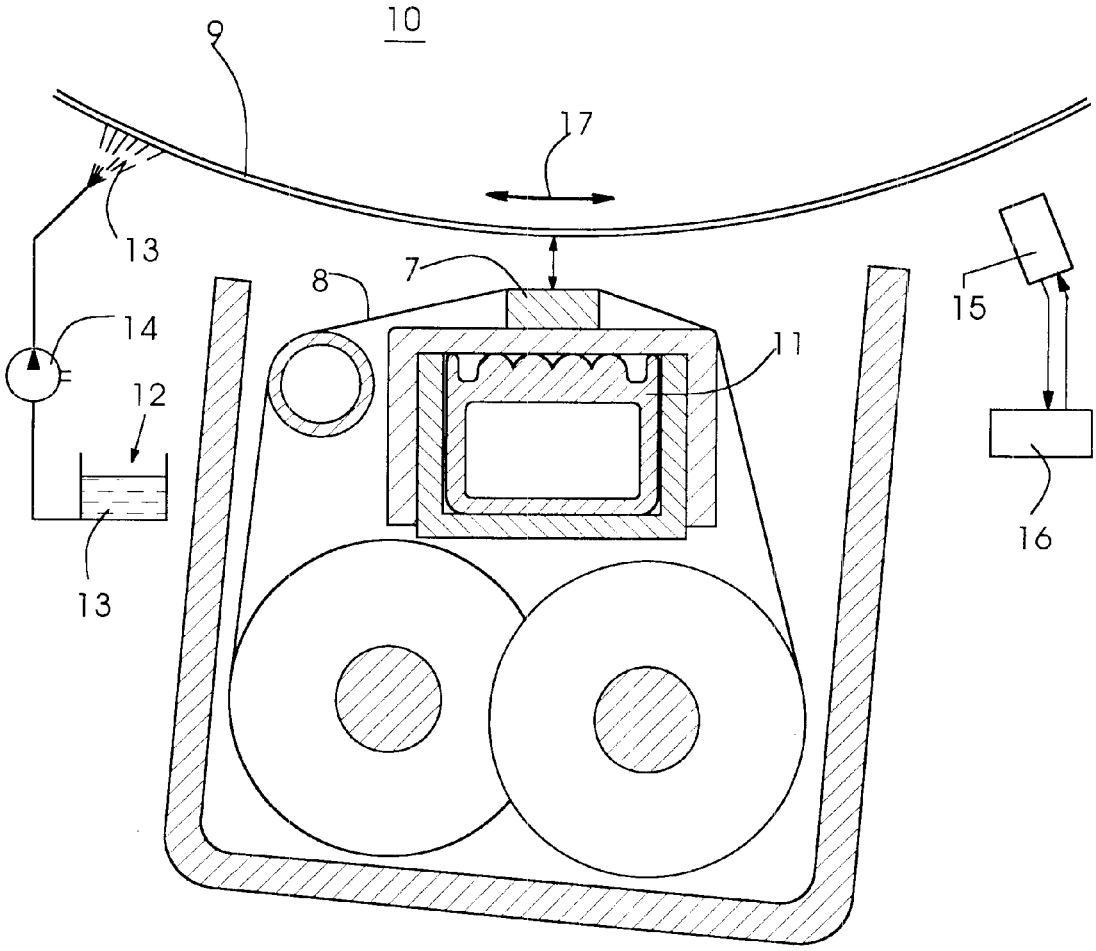
FIG. 2 is a diagrammatic and schematic cross-sectional view of a cleaning device for performing the method of cleaning a printing form in accordance with the invention.

Advantageously constructed cleaning equipment 7, 8 is shown in FIG. 2 and includes a cleaning cloth 8 advanceable with a stepping motion and bringable by an elastic press-on element 7 into engagement with the surface of a printing form 9, which may be clamped on a printing-form cylinder 10. The press-on or contact pressure to be applied can be preset by a profile tube element 11 which can be loaded with a pressure medium, for example, compressed air.

As diagrammatically and schematically illustrated in FIG. 2, a cleaning fluid 13 in a reservoir 12 can be fed by a pump 14 to the printing form 9, which is imaged directly by an imaging unit 15, the cleaning fluid 13 being sprayed directly onto the printing form 9, as shown, or onto an applicator and/or a cleaning roller, for example, a brush roller, or applied to the printing form 9 via a press-on element, particularly one with a surface-active material, and a cleaning cloth advanceable with a stepping motion. The printing-form cylinder 10 performs rotating motions in the crawl-speed mode of the printing press in both directions of rotation and is, in this regard, driven by the drive of the printing press. In this manner, both the imaging residues 5 behind the leading edges of the imaged halftone or screen dots, as well as the imaging residues 6 in the angle of the trailing edges are reliably removed by the cleaning arrangement (note FIG. 1). The press-on element 7 and the cleaning cloth 8 may perform a changing movement in the direction of the printing-form cylinder axis during the cleaning process.

The cleaning fluid may have the following exemplary composition:

| | |
|---|---|
| cleaning concentrate | 2.5 percent by volume |
| water | 97.5 percent by volume |

The cleaning concentrate, with respect to its total weight (percent by weight) may contain:

25% alkyl-benzene sulfonate

25% alcoholic ethoxylate 25 3% aliphatic acid diethanol amide

1% solubilizer

Furthermore, the cleaning concentrate may contain preservatives and complexing agents, and the percentage proportions of these components by weight of the cleaning concentrate may be less than 1%. The weight difference resulting between the sum of the foregoing percentages and 100% may be made up of water. The pH-value of the cleaning concentrate may be 7.

We claim:

1. A method of cleaning an imaged printing form having a silicone-based non-printing layer, which comprises:

providing a cleaning fluid containing:

water, a disinfectant having a sodium-silver chloride complex, and a cleaning concentrate having 1 to 30 percent by weight of an anionic surfactant and 1 to 30 percent by weight of a nonionic surfactant;

applying the cleaning fluid to a printing-form surface to be cleaned, the printing form surface being part of a printing form imaged with dot elements selected from the group consisting of halftone dots and screen dots, the printing form surface having a silicone-based non-printing layer; and exerting a defined contact pressure to the printing-form surface by pressing cleaning equipment against the printing-form surface;

while the cleaning equipment is pressed against the printing form surface, moving the printing form in a first direction of rotation and thereby removing imaging residues from leading dot-edges of the dot elements; and subsequently, while the cleaning equipment is pressed against the printing form surface, moving the printing form in a second direction of rotation that is opposite the first direction of rotation and thereby removing imaging residues from trailing dot-edges of the dot elements.

2. The method according to claim 1, wherein the cleaning concentrate contains alkyl-benzene sulfonate as an anionic surfactant.

3. The method according to claim 1, wherein the cleaning concentrate contains alcoholic ethoxylate as a nonionic surfactant.

4. The method according to claim 1, wherein the cleaning concentrate contains 0.1 to 5 percent by weight of a lubricant component.

5. The method according to claim 4, wherein the cleaning concentrate contains carbamide (urea) as the lubricant component.

6. The method according to claim 4, wherein the cleaning concentrate contains aliphatic acid diethanol amide as the lubricant component.

7. The method according to claim 1, wherein the cleaning concentrate contains 1 to 25 percent by weight of a solubilizer.

8. The method according to claim 1, wherein the cleaning concentrate contains preservatives.

9. The method according to claim 8, wherein the cleaning concentrate contains 0.05 to 3 percent by weight of the preservatives.

10. The method according to claim 1, wherein the cleaning concentrate contains complexing agents.

11. The method according to claim 10, wherein the cleaning concentrate contains 0.1 to 2 percent by weight of hardness stabilizers.

12. The method according to claim 1, wherein the cleaning fluid contains 1 to 25 percent by volume of the cleaning concentrate.

13. The method according to claim 12, wherein the cleaning fluid contains 1 to 2.5 percent by volume of the cleaning concentrate.

14. The method according to claim 1, wherein the cleaning fluid has a negative common logarithm of hydrogen-ion concentration with a value between 5 and 8.

15. A method of cleaning an imaged printing form having a silicone-based non-printing layer, which comprises:

providing a printing form that has a silicone-based non-printing layer and that has been imaged with dot elements selected from the group consisting of halftone dots and screen dots;

providing a cleaning fluid containing:

water, and 1 to 2.5 percent by volume of a cleaning concentrate having 1 to 30 percent by weight of an anionic surfactant and 1 to 30 percent by weight of a nonionic surfactant;

applying the cleaning fluid to the printing form; and exerting a defined contact pressure by pressing cleaning equipment against the printing form;

while the cleaning equipment is pressed against the printing form, moving the printing form in a first direction of rotation and thereby removing imaging residues from leading dot-edges of the dot elements; and subsequently, while the cleaning equipment is pressed against the printing form, moving the printing form in a second direction of rotation that is opposite the first direction of rotation and thereby removing imaging residues from trailing dot-edges of the dot elements.

16. The method according to claim 15, wherein the cleaning Concentrate contains alkyl-benzene sulfonate as an anionic surfactant.

17. The method according to claim 15, wherein the cleaning concentrate contains alcoholic ethoxylate as a nonionic surfactant.

18. The method according to claim 15, wherein the cleaning concentrate contains 0.1 to 5 percent by weight of a lubricant component.

19. The method according to claim 18, wherein the cleaning concentrate contains carbamide (urea) as the lubricant component.

20. The method according to claim 18, wherein the cleaning concentrate contains aliphatic acid diethanol amide as the lubricant component.

21. The method according to claim 15, wherein the cleaning concentrate contains 1 to 25 percent by weight of a solubilizer.

22. The method according to claim 15, wherein the cleaning concentrate contains preservatives.

23. The method according to claim 22, wherein the cleaning concentrate contains 0.05 to 3 percent by weight of the preservatives.

24. The method according to claim 1, wherein the cleaning fluid contains a disinfectant having a sodium-silver chloride complex.

25. The method according to claim 15, wherein the cleaning concentrate contains complexing agents.

26. The method according to claim 25, wherein the cleaning concentrate contains 0.1 to 2 percent by weight of hardness stabilizers.

27. The method according to claim 15, wherein the cleaning fluid has a negative common logarithm of hydrogen-ion concentration with a value between 5 and 8.

28. A method of cleaning an imaged printing form having a silicone-based non-printing layer, which comprises:

producing a printing form having a silicone-based non-printing layer and being imaged with dot elements selected from the group consisting of halftone dots and screen dots;

providing a cleaning fluid containing:

water, and a cleaning concentrate having 1 to 30 percent by weight of an anionic surfactant and 1 to 30 percent by weight of a nonionic surfactant;

applying the cleaning fluid to the printing form; and removing imaging residues by:

exerting a defined contact pressure to the printing form by pressing cleaning equipment against the printing form, while the cleaning equipment is pressed against the printing form, moving the printing form in a first direction of rotation and thereby removing imaging residues from leading dot-edges of the dot elements, and subsequently, while the cleaning equipment is pressed against the printing form, moving the printing form in a second direction of rotation that is opposite the first direction of rotation and thereby removing imaging residues from trailing dot-edges of the dot elements.

29. The method according to claim 28, wherein the cleaning concentrate contains alkyl-benzene sulfonate as an anionic surfactant.

30. The method according to claim 28, wherein the cleaning concentrate contains alcoholic ethoxylate as a nonionic surfactant.

31. The method according to claim 28, wherein the cleaning concentrate contains 0.1 to 5 percent by weight of a lubricant component.

32. The method according to claim 31, wherein the cleaning concentrate contains carbamide (urea) as the lubricant component.

33. The method according to claim 31, wherein the cleaning concentrate contains aliphatic acid diethanol amide as the lubricant component.

34. The method according to claim 28, wherein the cleaning concentrate contains 1 to 25 percent by weight of a solubilizer.

35. The method according to claim 28, wherein the cleaning concentrate contains preservatives.

36. The method according to claim 35, wherein the cleaning concentrate contains 0.05 to 3 percent by weight of the preservatives.

37. The method according to claim 28, wherein the cleaning fluid contains a disinfectant having a sodium-silver chloride complex.

38. The method according to claim 28, wherein the cleaning concentrate contains complexing agents.

39. The method according to claim 37, wherein the cleaning concentrate contains 0.1 to 2 percent by weight of hardness stabilizers.

40. The method according to claim 28, wherein the cleaning fluid contains 1 to 25 percent by volume of the cleaning concentrate.

41. The method according to claim 40, wherein the cleaning fluid contains 1 to 2.5 percent by volume of the cleaning concentrate.

42. The method according to claim 28, wherein the cleaning fluid has a negative common logarithm of hydrogen-ion concentration with a value between 5 and 8.

* * * * *